US007857551B2

(12) United States Patent
Heindl

(10) Patent No.: US 7,857,551 B2
(45) Date of Patent: Dec. 28, 2010

(54) CONNECTION ELEMENT FOR CONNECTING SHEET PILES TO CARRIER ELEMENTS AS WELL AS A COMBINATION SHEET PILE WALL WITH SUCH CONNECTION ELEMENTS

(75) Inventor: Richard Heindl, Munich (DE)

(73) Assignee: Pilepro, LLC, Rapid City, SD (US)

( * ) Notice: Subject to any disclaimer, the term of this patent is extended or adjusted under 35 U.S.C. 154(b) by 0 days.

(21) Appl. No.: 12/321,886

(22) Filed: Jan. 27, 2009

(65) Prior Publication Data

US 2009/0191008 A1 Jul. 30, 2009

(30) Foreign Application Priority Data

Jan. 28, 2008 (DE) ..... 10 2008 006 353

(51) Int. Cl.
*E02D 5/08* (2006.01)

(52) U.S. Cl. ..... 405/279

(58) Field of Classification Search ..... 405/279, 405/278, 277, 276, 274, 280, 281
See application file for complete search history.

(56) References Cited

U.S. PATENT DOCUMENTS

| | | | | |
|---|---|---|---|---|
| 1,098,077 | A * | 5/1914 | Annison | 405/279 |
| 1,681,593 | A * | 8/1928 | Pahl | 405/279 |
| 1,837,787 | A * | 12/1931 | Meiser | 405/279 |
| 2,104,490 | A * | 1/1938 | Kohler et al. | 405/279 |
| 6,042,306 | A * | 3/2000 | Arndts et al. | 405/279 |
| 7,387,471 | B2 * | 6/2008 | Heindl et al. | 405/274 |
| 7,413,386 | B2 * | 8/2008 | Heindl et al. | 405/279 |
| 7,527,456 | B2 * | 5/2009 | Heindl et al. | 405/279 |
| 7,566,190 | B2 * | 7/2009 | Heindl | 405/279 |
| 2005/0238443 | A1 * | 10/2005 | Heindl et al. | 405/277 |
| 2007/0243027 | A1 * | 10/2007 | Heindl et al. | 405/274 |
| 2008/0145154 | A1 * | 6/2008 | Heindl et al. | 405/279 |
| 2008/0175674 | A1 * | 7/2008 | Heindl | 405/278 |

FOREIGN PATENT DOCUMENTS

WO WO 02/35010 * 5/2002

* cited by examiner

*Primary Examiner*—Frederick L Lagman
(74) *Attorney, Agent, or Firm*—Karl F. Milde, Jr.; Eckert Seamans; Cherin & Mellott, LLC

(57) ABSTRACT

A connection element for connecting a sheet pile to a carrier element, with a base strip (16) to be fastened to a carrier element (14), is provided with an interlock profile (20) for engaging the sheet pile (14). The interlock profile (20) exhibits a lock chamber (28) that is defined by the base strip (16), a support strip (24) that protrudes from the base strip (16) and a hook strip (26) that protrudes from the base strip (16), whereby the hook strip (16) exhibits a straight extending transition section (32) protruding from the base strip (16) and a hook section (34) that follows said transition section and points in the direction of the support strip (34). The hook section exhibits a first support surface (26) that faces an inner surface (30) of the support strip (24), whereby the first support surface (36) and at least that section of the inner surface (30) of the support strip (24) that directly faces the first support surface (26) are located in parallel converging planes (E1, E2) and together define the jaw (42) of the lock chamber (28). The first support surface (36) transitions under an acute angle ($\alpha$) into a second support surface (38) that defines the lock chamber (28).

20 Claims, 9 Drawing Sheets

CONNECTION ELEMENT FOR CONNECTING SHEET PILES TO CARRIER ELEMENTS AS WELL AS A COMBINATION SHEET PILE WALL WITH SUCH CONNECTION ELEMENTS

BACKGROUND OF THE INVENTION

The invention concerns a connection element with a uniform cross-section for connecting a sheet pile to a carrier element. In addition, the invention concerns a combination sheet pile wall with such a connection element.

Connection elements of the type mentioned above are used to erect so-called combination sheet pile walls. A combination sheet pile wall is an arrangement of carrier elements and sheet piles where at least one sheet pile is placed between each of two carriers, for example I-beams. The sheet pile is coupled with the carrier element using the connection element named above.

For connecting the connection element to the carrier element, the base strip of the connection element is attached at the carrier element. If the carrier element is provided with fastening sections such as flanges, then the base strip is equipped with a suitable attachment profile that is used to slide the base strip onto the fastening section of the carrier element. However, if the carrier element is a carrier element without any additional fastening sections, like a tubular pile or a comparable carrier element, then the connection element is designed as a weld-on profile and is connected positively by welding it to the carrier element prior to piling.

Coupling of the sheet pile with the connection element is carried out using an interlocking profile that is designed at the connection element and in which the pile sheet interlock engages.

Combination sheet pile walls have a variety of applications and find particular use in coastal sections as bank support and as floodwater protection devices. The sheet pile interlocks as well as the interlocking profiles of the known connection elements are designed even for the tough application conditions that occur on the coast and can withstand the forces caused by the earth masses as well as those that arise from the surging seawaters.

However, the use of the known combination sheet pile walls in coastal sections of the arctic circle poses problems because, in addition to the typical forces acting on the combination sheet pile walls, in particular on the sheet pile interlocks and the engaged interlocking profiles of the connection elements, extreme forces caused by pack ice are present during the winter months. For example, the coastal sections ice over entirely during the winter months and sheets of pack ice are driven by the ocean currents towards the coastal sections, where sheets of ice tower up in meters high pack ice walls that press against the combination sheet pile walls.

The past has shown that the combination sheet pile walls that were provided for the protection of these coastal sections were not able to withstand the forces caused in particular by the pack ice. The sheet pile interlocks, in particular locks of the so-called LARSSEN type (DIN EN 10248-2 and E 67 of EAU 2005), break at an above average frequency, especially in those areas where the sheet piles engage with the connection elements. One reason for this may be that the sheet pile interlocks are not able to make sufficient evasive movements in the interlocking profiles of the connection elements.

SUMMARY OF THE INVENTION

It is, therefore, the object of the invention to provide a connection element or a combination sheet pile wall, respectively, that is or that are designed for extreme application conditions, in particular in coastal sections with high pack ice formation.

With the connection element according to the invention, a result of the design of the interlocking profile is that the sheet pile interlock that engages in the interlocking profile is supported uniformly and in a large area. At the same time, the interlocks that engage in each other are supported effectively. The connection element according to the intervention is used in particular with so-called LARSSEN sheet piles. The weakest spot with LARSSEN sheet piles proved to be in particular the transition between the sheet pile and the hook-shaped bent end. The hook section of the connection elements according to the invention exhibit two support surfaces, a first support surface that runs essentially parallel to the direction of expansion of the sheet pile and a second support surface that runs, when viewed in the cross-section (that is, perpendicular to the longitudinal direction of the connection element) slanted under an angle of 40 to 50° to the first support surface. As soon as great forces, for example those caused by pack ice, press the sheet pile and thus the LARSSEN interlock in the direction of the hook strip of the interlock profile of the connection element, the LARSSEN interlock is supported effectively by both support surfaces of the connection element. At the same time, the support strip of the connection element, which, according to the invention, extends at least in sections across the first support surface, protects the LARSSEN interlock, in particular its transition between the sheet pile and the angled hook section, from external influences such as sheets of pack ice. On the other hand, if the sheet piles engage in the connection element such that the occurring forces act in the direction of the support strip, then the LARSSEN interlock is, for one, supported at the angled support surface of the hook strip and, at the same time, with a large area at the inside surface of the support strip. In this manner, the transition section and the hook strip themselves protect the LARSSEN interlock, in particular its transition between the sheet pile and the angled hook section.

To ensure sufficient support of the sheet pile interlock, the length of the first support surface, in a cross-sectional view, and the length of the section of the inside surface that is facing the first support surface corresponds at least approximately to the length of the second support surface. This ensures that the sheet pile interlock in its end position contacts a large area of the support surface or the first support surface and the inner surface, respectively, and in this manner the transition between the sheet pile and the interlock is supported effectively and over a large surface area.

The connection element according to the invention is preferably manufactured by extrusion molding; however, it can also be manufactured by other manufacturing methods such as warm rolling, for example.

Additional advantages of the invention can be derived from the following description, the drawing and the subclaims.

To ensure sufficient stiffness of the hook strip, in one preferred embodiment of the connection element according to the invention, the first support surface transitions into a first outer surface of the hook section that points outward, whereby the plane in which the first outer surface extends runs at an angle of at least 90° in a cross-sectional view, while the first outer surface transitions under formation of a radius into the second outer surface of the transition section that points outward. This ensures that tensions acting at the hook section of the hook strip are uniformly diverted to the base strip by the transition section.

In a particularly preferred advancement of this preferred embodiment, the angle between the first support surface and the first outer surface is in a range of 100 to 110°. This design feature achieves additional thickening and thus stiffening of the transition between the hook section and the transition section such that the hook strip can withstand extremely high stresses. At the same time, the arising tensions are diverted effectively here as well, and that without interference to the transition section and thus to the bases strip by the uniform and rounded contour of the outer surface.

The support strip and the hook strip of the connection element according to the invention can, in a cross-sectional view, extend slanted at a specified angle relative to the base strip, for example at an angle of 60°. This allows the sheet pile to be attached to the carrier element at a specified angle. It is only important that the inner surface of the support strip and the first support surface of the hook strip extend in parallel planes. It is particularly preferred if the inner surfaces of the support strip and the transition section run at least approximately at a right angle to the longitudinal direction of the base strip, such that the sheet pile can be arranged in a common line to and coupled with the carrier element.

To keep the weight of the connection element according to the invention as low as possible, in a particularly preferred embodiment of the connection element according to the invention the thickness of the transition section of the hook strip perpendicular to its longitudinal extension is dimensioned such that it corresponds at least to 1.1 times to 1.4 times of the maximum thickness of the support strip. Because the support strip shall only protect and support the sheet pile interlock, while the hook strip not only protects the sheet pile interlock but at the same time also serves as a counter piece for engaging the interlock, the support strip can be dimensioned smaller than the hook strip. Because of this, the weight of the connection element is lower in comparison to a solution where both strips, the support strip and the hook strip are dimensioned equally, in a cross-sectional view. However, for extremely high stress conditions, the support strip and the hook strip may be dimensioned equally.

To ensure that the sheet pile interlock is supported properly in any installation position, it is recommended in a particularly preferred embodiment of the connection element according to the invention to dimension the interlock profile of the connection element such that the sheet pile interlock is movable between a first installation position in which the interlock rests against the first support surface and the second support surface of the hook strip, and a second installation position in which the interlock rests against the inner surface of the support strip and the second support surface of the hook strip.

To ensure sufficient movability of the sheet pile interlock in the connection element, in particular with the embodiment described, it is additionally recommended that the width of the jaw and the minimum permissible distance between an imaginary section line of the plane where the first support surface is located, and the plane in which the second support surface is located, as well as the inner surface of the base strip that defines the lock chamber, fulfill the following condition when viewed in a direction parallel to the plane of the first support surface:

$$b \leq \frac{a}{\tan\alpha}$$

where $\alpha$ is the acute angle at which the first and the second support surfaces run slanted towards each other. Adhering to this condition ensures that the inner surface of the base strip does not hamper the movement of the sheet pile interlock.

Advantageously, the lock chamber is designed essentially in the shape of a right angle, which means that the inner surface of the base strip that defines the lock chamber extends in a plane and that the inside surface of the base strip runs at a right angle both to the inside surface of the support strip and to the inside surface of the transition section, in a cross-sectional view.

Preferably, the connection element according to the invention is used for connecting sheet piles to LARSSEN interlocks according to DIN EN 10248-2 and E 67 of EAU 2005 or also HOESCH sheet piles with LARSSEN hooks. Accordingly, it is recommended to design the interlock profile for receiving a lock of a LARSSEN interlock to be attached.

If the connection element is to be connected with a carrier element, at which a suitable fastening section is provided, for example in the form of a flange, then it is recommended to provide an attachment profile for a connection to the carrier element at the base strip that points away from the interlock profile. The attachment profile that is provided at the connection element can be designed differently depending on the carrier element to be used.

For example, if the connection element is used with a carrier element, where a fastening section is provided at the carrier element and said fastening section has an approximately wedge-shaped cross-section, for example a club-shaped carrier, then the connection profile at a particularly preferred embodiment of the connection element according to the invention is defined by the base strip, by a first straight jaw strip that protrudes from one side of the base strip at an angle of 90° and a second jaw strip that that originates from the other side of the base strip and is bent in the direction of the first straight jaw strip.

Depending on the later position of the connection element at the carrier element, the bent second jaw strip of the connection profile is designed either directly adjacent to the support strip of the interlock profile or adjacent to the transition section of the hook strip at the base strip. On the other hand, if a carrier element is used, where the fastening section has an approximately rectangular cross-section, the connection profile has, at an additional alternative embodiment of the connection element according to the invention, in a cross-sectional view, two jaw strips that protrude from the base strip and that at least approximately run parallel towards each other, between which the carrier element is to be inserted with its fastening section.

In one particular preferred embodiment of the connection element according to the invention, the connection profile, when viewed in the cross-section of the connection element, is designed with regard to the interlock profile offset at the base strip such that one of the two jaw strips is offset toward the outside with regard to the transition section of the hook strip. This accomplishes that the carrier element, when it engages with its fastening section in the attachment profile of the connection element, protrudes further toward the outside from the carrier element than the sheet pile section with which the sheet pile protrudes outward, in a cross-sectional view. This is particularly advantageous if the combination sheet pile wall is used in ports or at landings because, for example, a ship that unintentionally moves against the combination sheet pile wall will bump only against the carrier elements while the sheet piles are protected from damage.

If, however, the carrier element is not equipped with a suitable fastening section, for example a tubular pile, then the connection element is designed as a weld-on element that can be connected positively with the carrier element for welding. To this end, the connection element provided at that side of its base strip that points away from the interlock profile is preferably provided with two weld-on elevations that expand in the longitudinal directions of the connection element where said elevations run parallel at a distance to each other, advantageously near the two face sides of the base strip.

According to one aspect, the invention concerns a combination sheet pile wall that uses the connection element according to the invention. In this application, a particularly preferred use of the connection element according to the inventions is for coupling sheet piles with LARSSEN interlocks.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
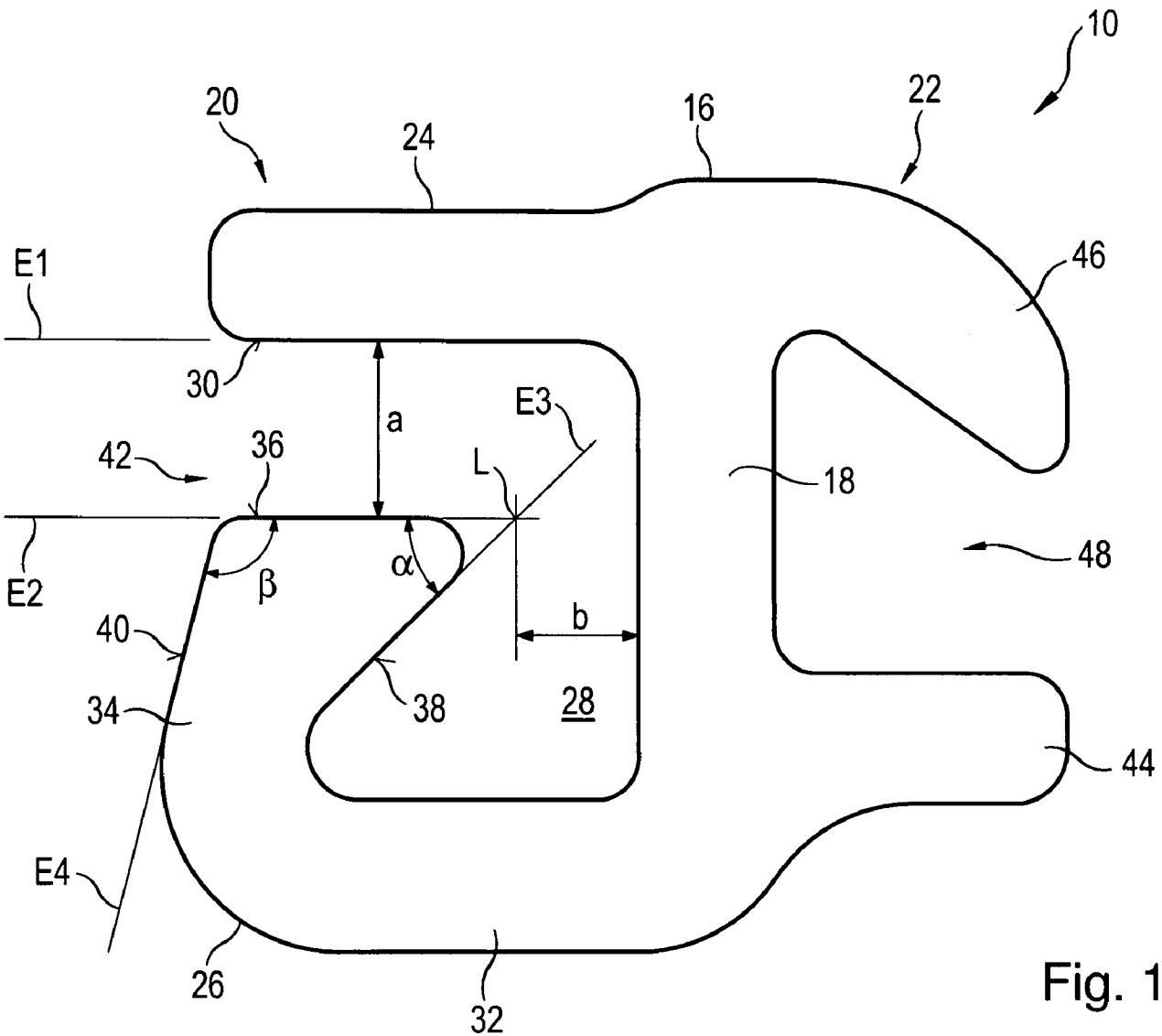
FIG. 1 shows a top view of the face side of a first exemplary embodiment of a connection element according to the invention that is provided with a hook strip and a support strip.

The preferred embodiments of the present invention will now be described with reference to FIGS. 1-9 of the drawings. Identical elements in the various figures are designated with the same reference numerals.

Figure 2:
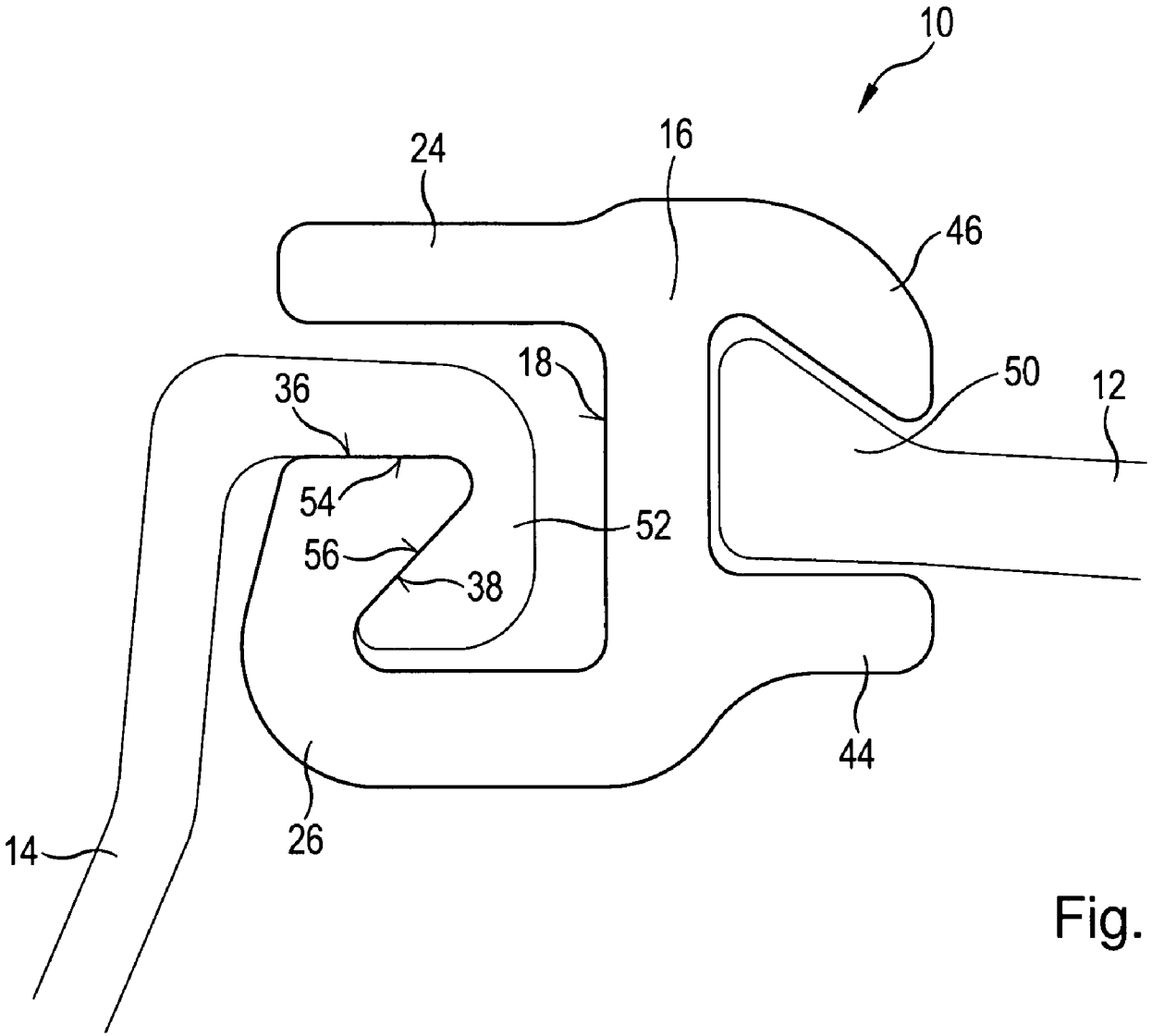
FIG. 2 is a top view of the connection element shown in FIG. 1 that engages with a club-type carrier and a LARSSEN interlock of a sheet pile, whereby the LARSSEN interlock rests against a first support surface and a second support surface of the hook strip of the connection element.
Figure 3:
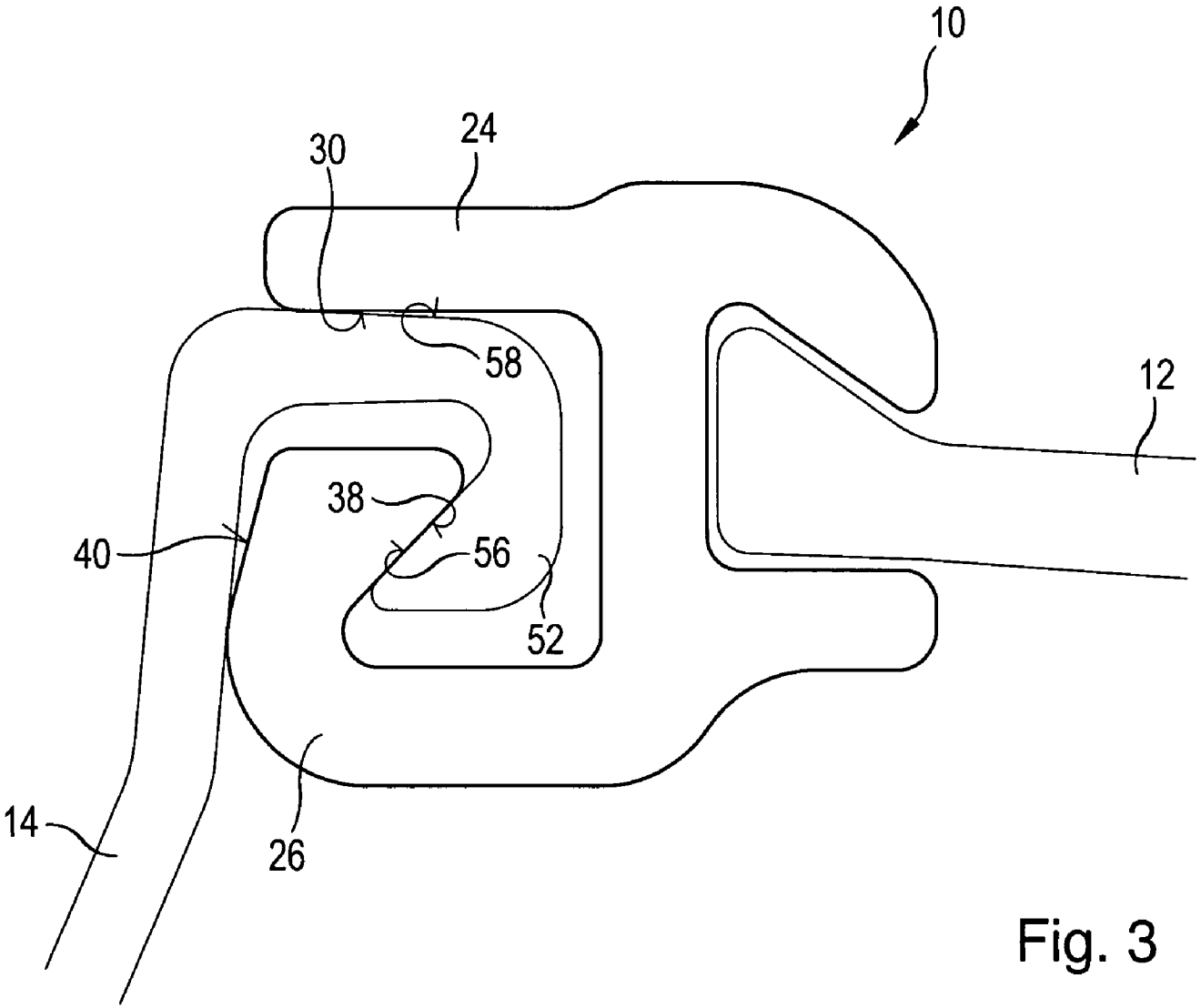
FIG. 3 is a top view of the connection element shown in FIG. 1 that engages with a club-type carrier and a LARSSEN interlock of a sheet pile, whereby the LARSSEN interlock rests against the second support surface of the hook strip as well as the inner surface of the support strip of the connection element.

FIGS. 1 to 3 show a first exemplary embodiment of a connection element 10 according to the invention that is used to connect a carrier element 12 to a sheet pile 14 (cf. FIGS. 2 and 3). The connection element 10 exhibits a central base strip 16 with a straight, plane central section 18. An interlock profile 20 for coupling to the sheet pile 14 is formed at the flat side of the central section 18 shown in FIG. 1 on the left. An attachment profile 22 for connecting to the carrier element 12 is formed at the second flat side of the central section 18 that faces away.

The interlock profile 20 is formed by a support strip 24 and a hook strip 26, which together with the central section 18 of the base strip 16 define a lock chamber 28.

Beginning at the longitudinal edge of the base strip shown in FIG. 1, the support strip 24 protrudes at least approximately at a right angle from the flat side of the base strip 16. The support strip has at its inner side a flat inner surface 30 that in the shown exemplary embodiment is located in a plane E1. The plane E1 extends under an angle of at least approximately 90° to the plane central section 18 of the base strip 16.

The hook strip 26 exhibits a straight extending transition section 32 that also protrudes at least approximately at a right angle from the flat side of the base strip 16, with the one end of said transition section transitioning flush into the longitudinal edge of the base strip 16 shown at the bottom of FIG. 1. The other end of the transition section 32 is bent and transitions into a hook section 34.

At its free end that faces the support strip 24, the hook section 34 exhibits a club-shaped expansion and a flat extending first support surface 36. The first support surface 36 extends in a plane E2 that runs parallel to the plane E1 in which the inner surface 30 of the support strip 24 is located. The first support surface 36 transitions in the direction of the lock chamber 28 into a second support surface 38 that is located in a third plane E3 forming a radius. The third plane E3 runs at an acute angle $\alpha$, which is in a 40 to 50° range. In the exemplary embodiment shown, the acute angle $\alpha$ is about 45°.

The length of the first support surface 36, in a cross-sectional view, and the length of the section of the inner surface 28 of the support strip 24 that is directly facing the first support surface 36 correspond at least approximately to the length of the second support surface 30. This ensures that the sheet pile interlock 12 in its two end positions, which will be described in greater detail below, contacts a large surface area and in this manner, in particular the transition between the sheet pile and the interlock, is supported effectively and over a large surface area.

Toward the outside, the first support surface 36 transitions into a first outer surface 40 that extends in a fourth plane E4. In relation to the second plane E2, the forth plane E4 is slanted by an angle $\beta$ that is in a 100 to 110° range. In the exemplary embodiment shown, the acute angle $\beta$ is about 105°.

The first support surface 34 and the inner surface 30 of the support strip 24 define the jaw 42 of the lock chamber 28. The width of the jaw 42 and the distance from the hook strip 26 to the central section 18 of the base strip 16 are adapted to each other. To ensure that the interlock of the sheet pile 14 that is to engage remains movable in the lock chamber 28 along the second support surface 38, it must be ensured that the lock chamber 28 is dimensioned adequately. For this reason, it is recommended according to the invention that the width of the jaw 42 and the minimum permissible distance b between an imaginary section line L of the second plane E2 and of the third plane E3 as well as the inner surface of the central section 18 of the base strip 16 that defines the lock chamber 28 fulfill the following condition when viewed in a direction parallel to the second plane E2 of the first support surface 36:

$$b \leq \frac{a}{\tan\alpha}.$$

In adhering to these conditions, it is always ensured that the interlock of the sheet pile 14 is securely supported in both potential final positions as will be explained in detail below.

The attachment profile 22 is defined by the base strip 16, by a first jaw strip 44 that protrudes at an angle of 90° near the longitudinal edge of the base strip 16 shown at the bottom of FIG. 1, and by a second bent jaw strip 46 that protrudes in the direction of the first straight jaw strip 44 from the longitudinal edge of the base strip 16 shown above. The two jaw strips 44 and 46 end in a plane A that runs at least approximately parallel to the base strip 16 and enclose together with the base strip 16 a receptacle 48 with an approximately trapezoidal cross-section for engaging a fastening section 50 of the carrier element 12 (cf. FIGS. 2 and 3).

As FIG. 2 shows, the trapezoidal cross-section of the receptacle 48 is adapted to the cross-sectional shape of the fastening section 50 of the carrier element 12, for example an I-beam, such that the attachment profile 22 can be slipped onto the fastening section 50 of the carrier element 12 with little play. In the example shown, the fastening section 50 exhibits a cross-section that expands towards its free end in the shape of a wedge.

In the assembled state, the connection element 10 according to the invention is slid onto the wedge-like expanding fastening section 50 of the I-beam 12 with its attachment profile 22 as shown in FIGS. 2 and 3.

As has already been explained above, the design of the interlock profile 20 according to the invention enables in particular the engaging of a so-called LARSSEN interlock 52 of a sheet pile 14. In the applications shown in FIGS. 2 and 3, the connection element 10 is fastened at a club-type carrier element 12 and engages with the LARSSEN interlock 52 of the sheet pile 14.

As FIGS. 2 and 3 show, the LARSSEN interlock 52 can be moved back and forth along the second support surface 38 between two end positions.

In the first end position shown in FIG. 2, the LARSSEN interlock 52 rests with its inner side 54 against the first support surface 36 and with its hook surface 56 against the second support surface 38. This ensures a particularly large area support of the entire interlock surface of the LARSSEN interlock 52, while at the same time the support strip 24 protects the LARSSEN interlock 52 from external influences.

In the second end position shown in FIG. 3, the LARSSEN interlock 52 rests with its outer side 58 at least in sections against the inner surface 30 of the support strip 24, while at the same time being supported at the second support surface 38 with its hook surface 56. In addition, the sheet pile 14 is supported at the first outer surface 40 of the hook strip 26 with its side that faces the connection element 10. This provides support at three locations providing a secure hold for the LARSSEN interlock 52 in the connection element 10 in this installation position as well and allowing for even extremely high forces that attack the assembly to be taken up and diverted to the carrier element 12.

Above, the attachment profile 22 is shown with a trapezoidal cross-section. It is, of course, possible to provide other attachment profiles that are adapted in a corresponding fashion to the respective carrier element 12.

Figure 4:
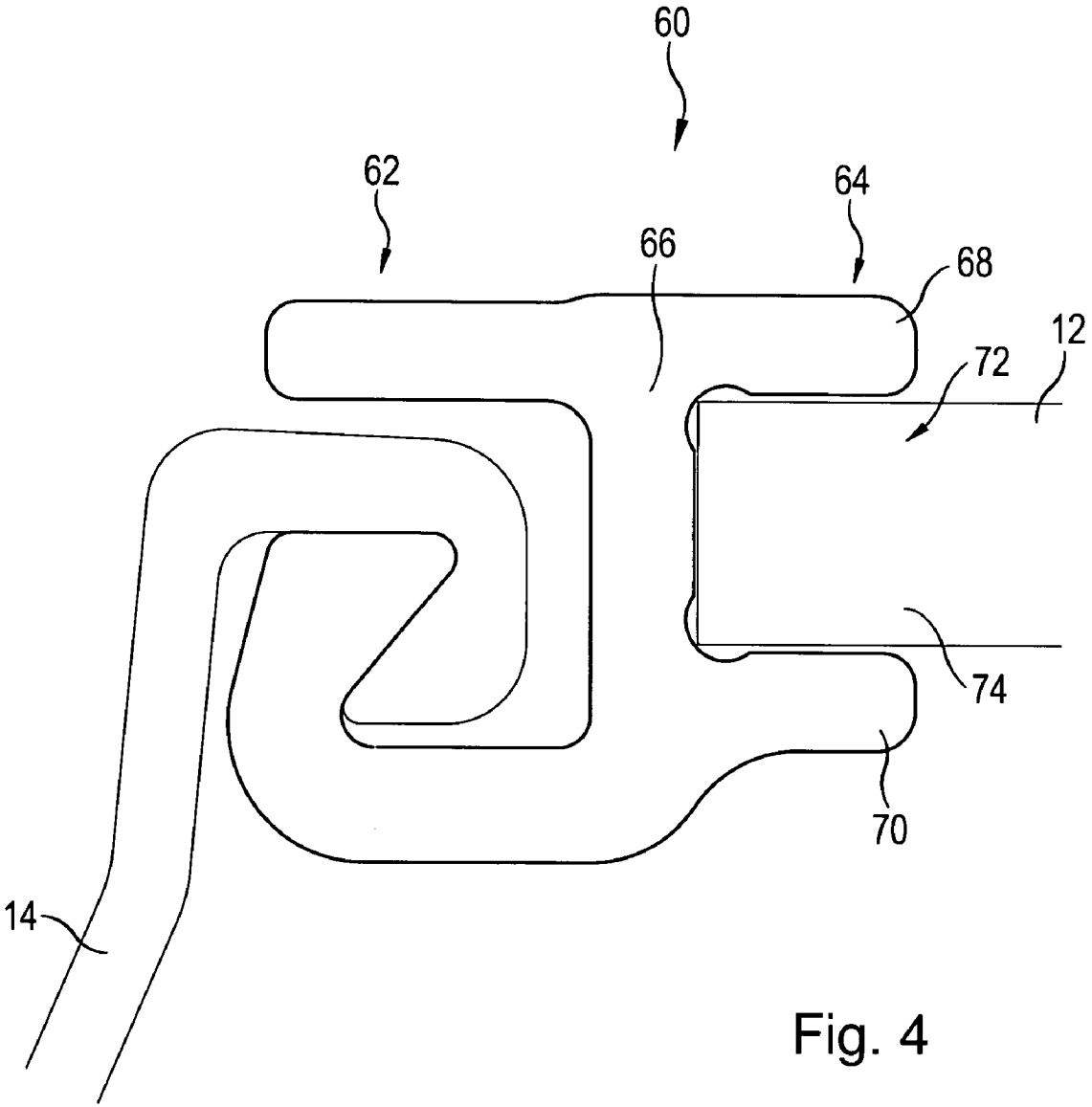
FIG. 4 is a top view of a first variation of the exemplary embodiment of the connection element shown in FIG. 1, which is designed with an, in a cross-sectional view, a rectangular fastening section for attachment to a conventional I-beam.

For example, FIG. 4 shows a first variation of the connection element 10 that is shown in FIGS. 1 to 3. In this modified connection element 60, the interlock profile 62 corresponds to the interlock profile 20.

However, the attachment profile 64 of the connection element 60 exhibits two jaw strips 68 and 70 that protrude from the base strip 66 approximately at a right angle and are designed mirror-symmetrical to each other. This results in a jaw 72 with an approximately rectangular cross-section for sliding onto a fastening section 74 with an approximately rectangular cross-section of a carrier element 12 such as a conventional I-beam.

Figure 5:
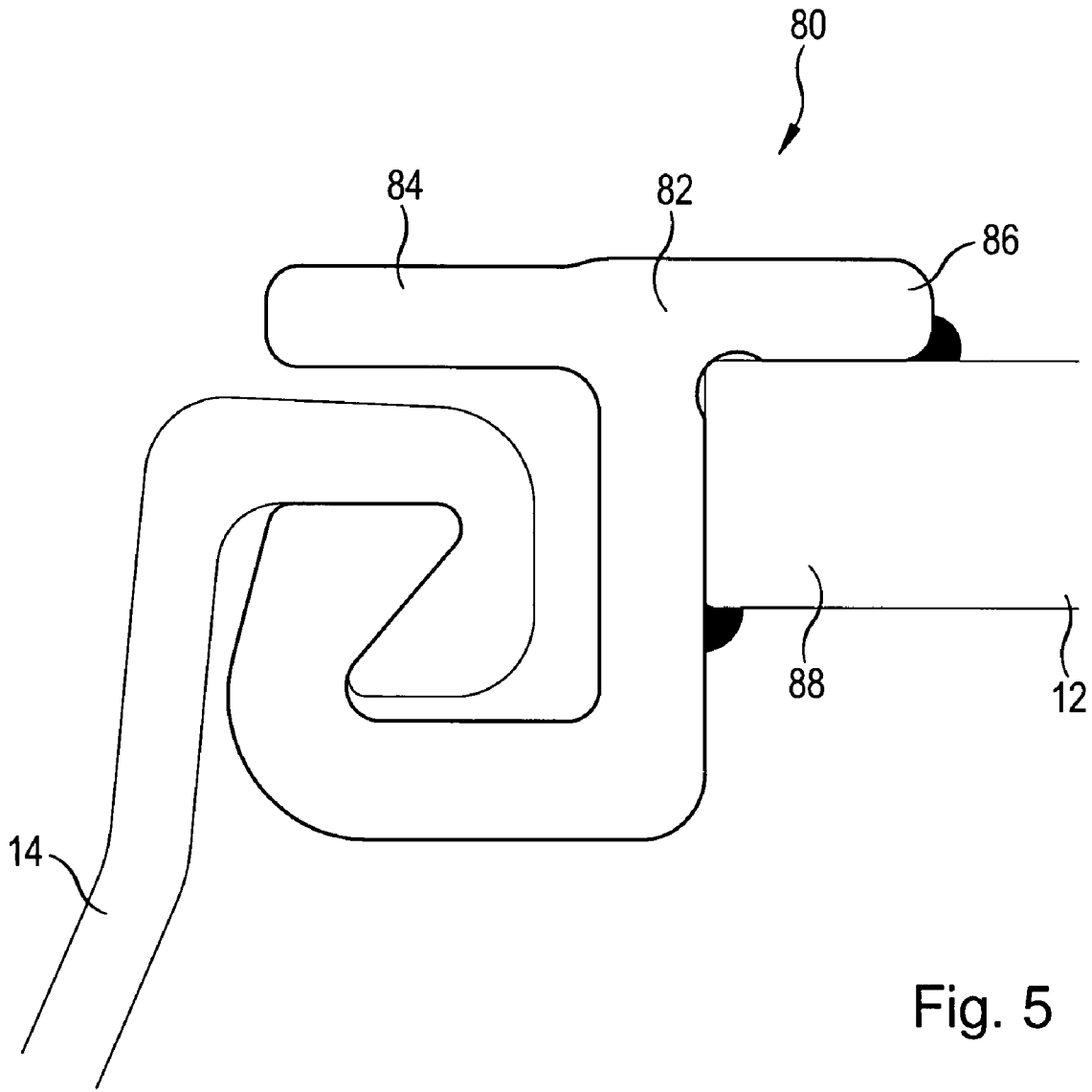
FIG. 5 is a top view of a second variation of the exemplary embodiment of the connection element shown in FIG. 1 with a support strip for welding to a conventional I-beam with an, in a cross-sectional view, rectangular fastening section.

FIG. 5 shows a second variation of the connection element 10 that is shown in FIGS. 1 to 3. With this connection element 80, only one weld-on strip 86 protrudes from the base strip 82 near the support strip 84 that can be used to weld the connection element 80 to a fastening section 88 of the carrier element 12.

Figure 6:
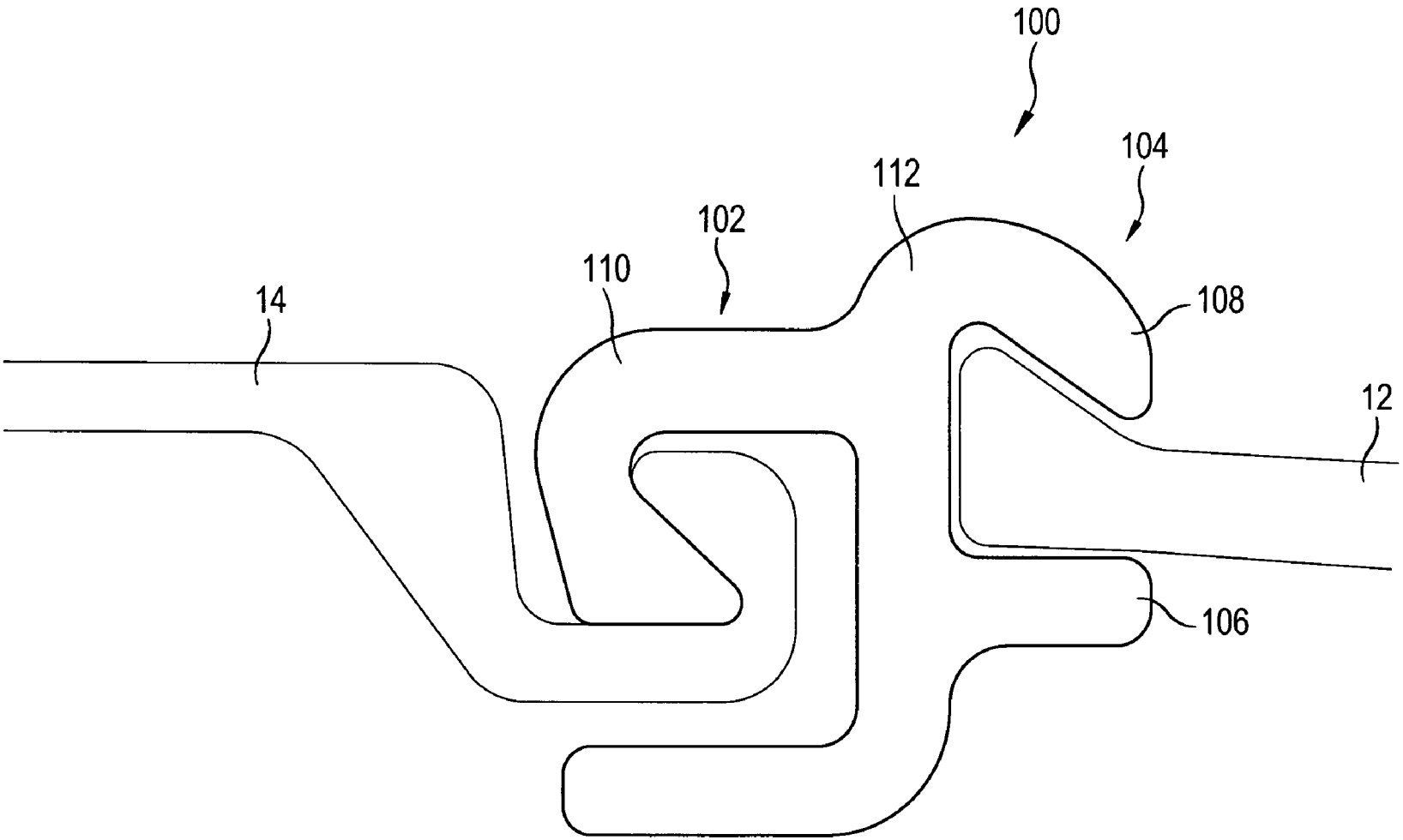
FIG. 6 is a top view of a second exemplary embodiment of the connection element according to the invention, where the attachment profile for the club-type carrier is designed at the base strip, mirror-inverted and offset compared to the exemplary embodiment shown in FIG. 1.

FIG. 6 shows a second exemplary embodiment of a connection element 100 according to the invention. With this connection element 100, the interlock profile 102 corresponds in its design to the interlock profile 20. The inner cross-section of the connection profile 104 also corresponds to the inner cross-section of the connection profile 22. However, the two jaw strips 106 and 108 are designed mirror-inverted when compared to the jaw strips 46 and 48 of the connection profile 22 shown in FIGS. 1 to 3.

For example, the bent jaw strip 108 is designed adjacent to the hook strip 110 of the interlock profile 102 at the base strip 112, with the base strip 112 extending beyond the hook strip 110 and transitioning with its longitudinal edge into the bent jaw strip 108. The straight jaw strip 106, on the other hand, protrudes from the flat side of the base strip 112 outward, such that the connection profile 104 is designed at the base strip 112 offset toward the outside by a total of approximately one wall thickness of the hook strip 110. This results in the connection element 100 being able to be attached to the hook strip 110 facing inward at the carrier element 12, such that the sheet pile 14 can engage in the interlock profile 102 in the opposite manner.

The offset design of the connection profile 104 results in the connection element 100 according to the invention holding the sheet pile 14 after its mounting on the carrier element 12 in such a manner that the carrier element 12 with its fastening section 50 protrudes outward beyond the sheet pile 14 with its sheet pile section that protrudes the furthest.

Figure 7:
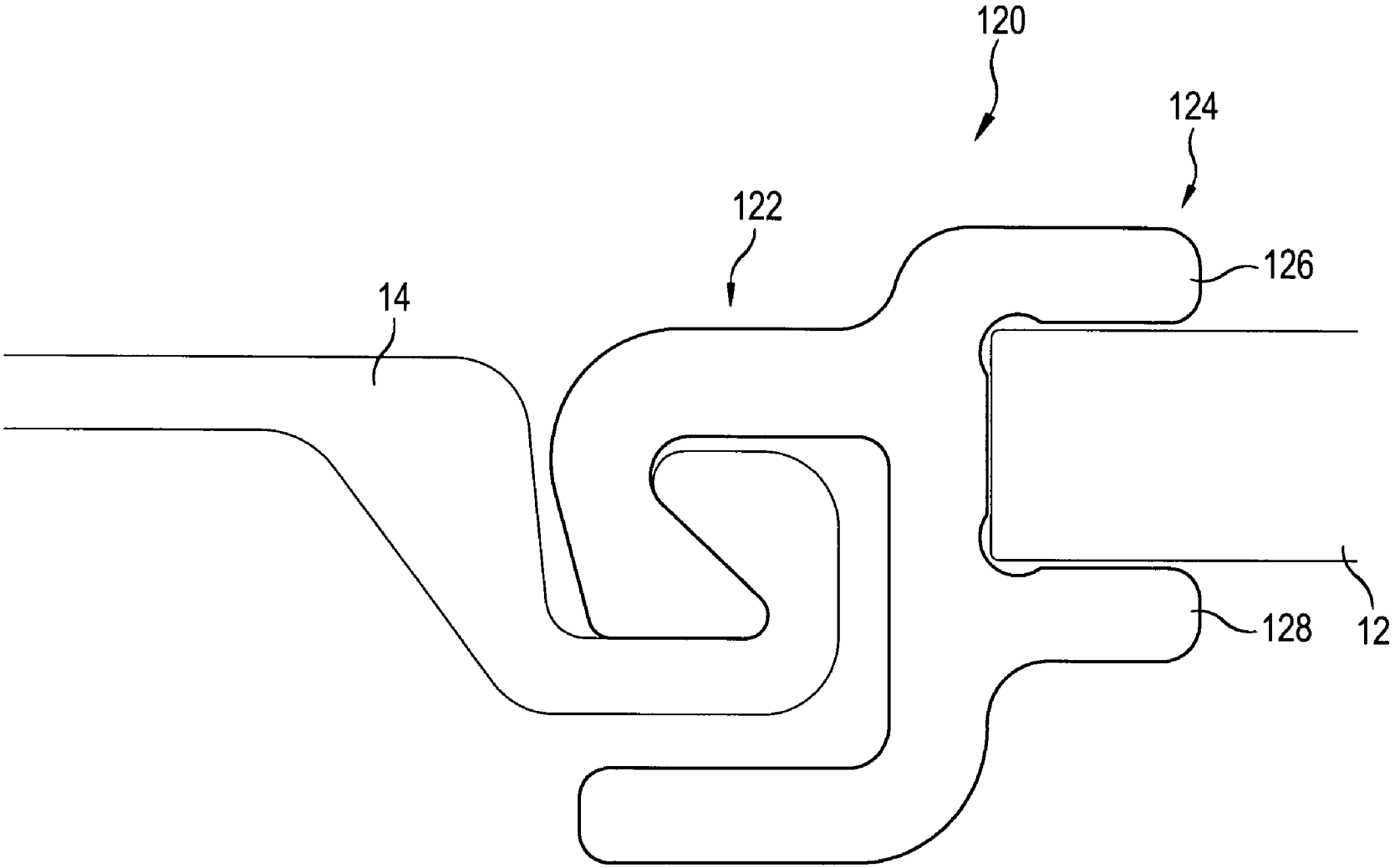
FIG. 7 is a top view of a first variation of the second exemplary embodiment shown in FIG. 6, which is designed with an, in a cross-sectional view, rectangular fastening section for attachment to a conventional I-beam.

FIG. 7 shows a first variation of the connection element 100 shown in FIG. 6. This modified connection element 120 exhibits an identically designed interlock profile 122 and differs from the connection element 100 only in the design of its attachment profile 124. In this case, the attachment profile 124 is formed of two parallel converging jaw strips 126 and 128 as shown in FIG. 4 for the variation of the first exemplary embodiment.

Figure 8:
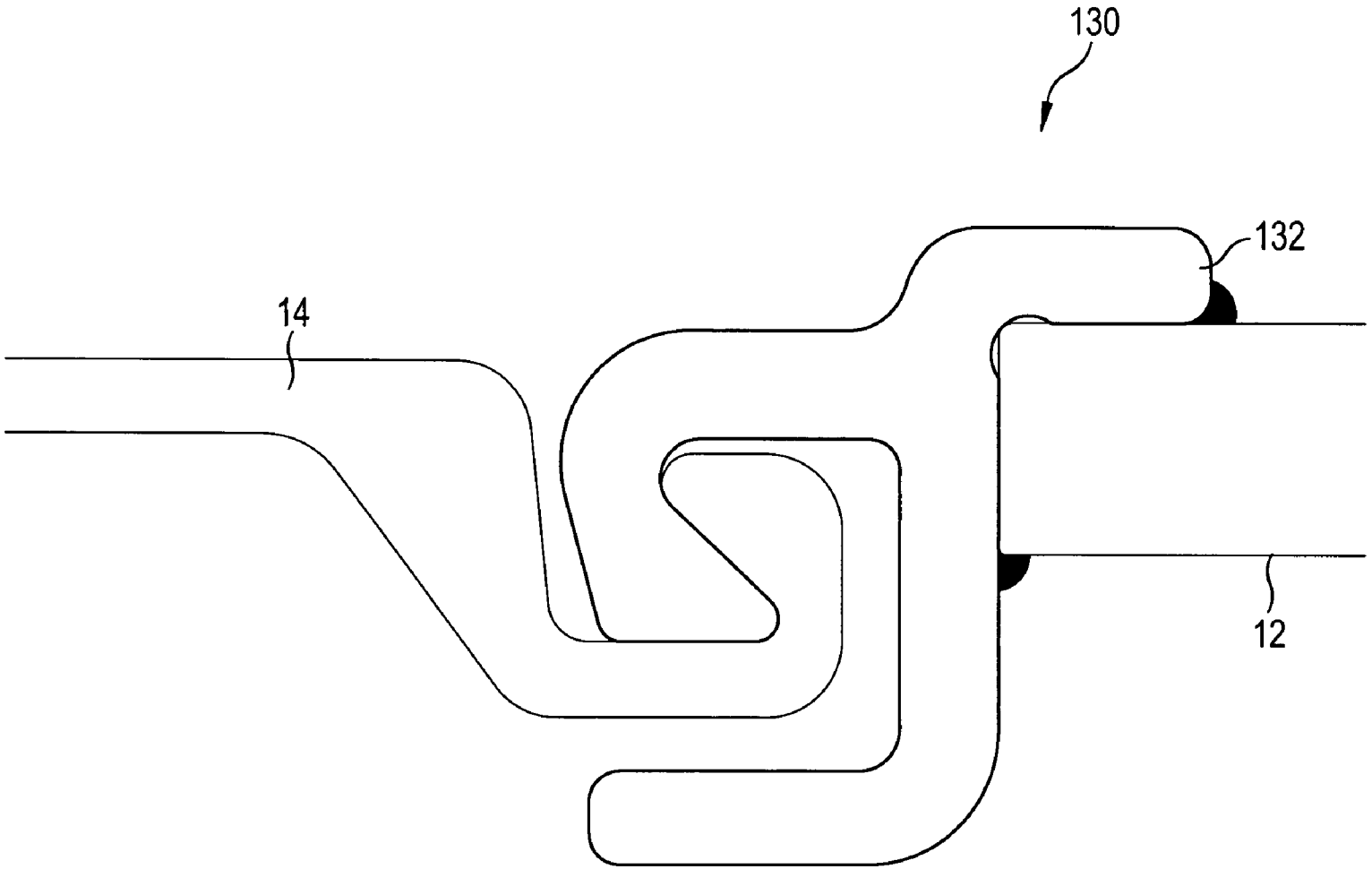
FIG. 8 is a top view of a second variation of the second exemplary embodiment of the connection element shown in FIG. 6 with a support strip for welding to a conventional I-beam with an, in a cross-sectional view, rectangular fastening section.

FIG. 8 shows a second variation of the connection element 100 shown in FIG. 6. With this modified connection element 130, only a weld-on strip 132 is provided as shown in FIG. 5 for the second variation that can be used to weld the connection element 130 to the carrier element 12 that is designed as a T-beam or I-beam.

Figure 9:
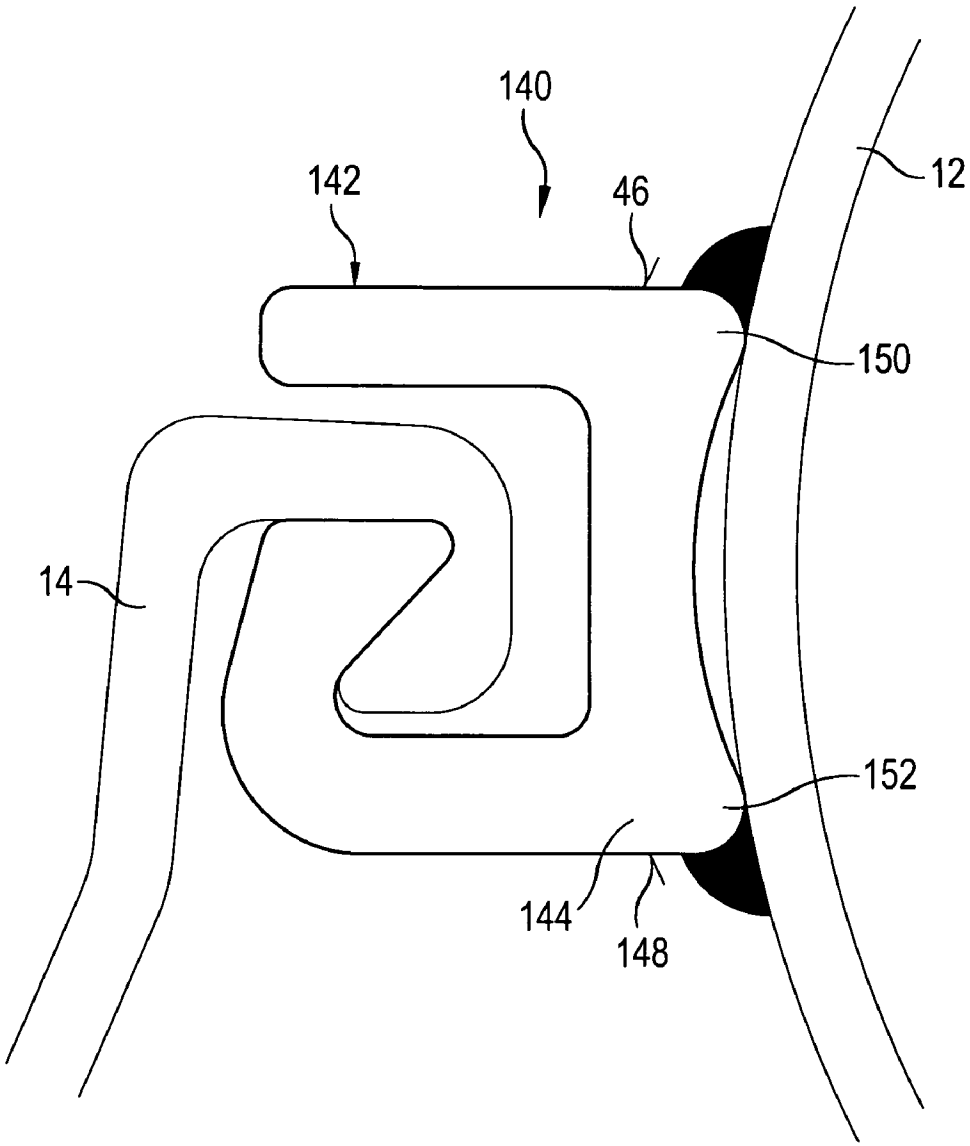
FIG. 9 is a top view of a third exemplary embodiment of a connection element according to the invention that is designed as a weld-on element.

FIG. 9 shows a third exemplary embodiment of a connection element 140 that is designed as a weld-on element. The connection element 140 exhibits an interlock profile 142 that corresponds to the interlock profile 20 shown in FIGS. 1 to 3. In this embodiment, the side of the base strip 144 facing away from the interlock profile has a concave design such that the longitudinal edges 146 and 148 transition into rounded weld-on strips that can be used to weld the connection element 140 to a carrier element 12 that may be designed as a tubular pile, for example.

There has thus been shown and described a novel a connection element for connecting sheet piles to carrier elements as well as a combination sheet pile wall with such connection elements which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A connection element with a uniform cross-section for connecting a sheet pile to a carrier element, with a base strip having two sides, which is adapted to be fastened on one side to the carrier element and which is provided with an interlock profile on an opposite side for engaging the sheet pile; wherein the interlock profile exhibits a lock chamber that is defined by the base strip, a straight support strip that protrudes outward from said opposite side of the base strip and a curved hook strip that protrudes outward from said opposite side of the base strip, whereby the hook strip exhibits a straight extending transition section protruding from the base strip and a hook section that follows said transition section and points in the direction of the support strip; wherein said hook section exhibits a first support surface that faces an inner surface of the support strip, whereby the first support surface and at least that section of the inner surface of the support strip that directly faces the first support surface are located in parallel planes (E1, E2) and together define the jaw of the lock chamber; wherein the first support surface transitions under an acute angle ($\alpha$) into a second support surface that forms a part of the lock chamber; wherein the acute angle ($\alpha$) between a plane (E3), in which the second support surface extends, and the plane (E2), in which the first support surface extends, exhibits, in a cross-sectional view, a value in the 40 to 50° range, and wherein, in a cross-sectional view, the length of the first support surface and the length of the section of the inner surface that directly faces the first support surface both correspond at least approximately to the length of the second support surface.

2. A connection element as defined in claim 1, wherein the first support surface transitions into a first outer surface of the hook section that points outward, whereby a plane (E4) in which the first outer surface extends runs at an angle ($\beta$) of at least 90° in a cross-sectional view, and wherein the first outer surface transitions under formation of a radius into the second outer surface of the transition section that points outward.

3. A connection element as defined in claim 2, wherein the angle ($\beta$) between the first support surface and the first outer surface is in a 100 to 110° range.

4. A connection element as defined in claim 1, wherein the inner surface of the support strip and the transition section of the hook strip extend, in a cross-sectional view, at least approximately at a right angle to the longitudinal direction of the base strip.

5. A connection element as defined in claim 1, wherein the thickness of the straight transition section, viewed perpendicular to its longitudinal expanse, corresponds at least to 1.1 to 1.4 times the thickness of the support strip, which is approximately rectangular in a cross-sectional view.

6. A connection element as defined in claim 1, wherein the interlock profile is dimensioned such that the interlock of the sheet pile is movable between a first installation position in which the interlock rests against the first support surface and the second support surface of the hook strip, and a second installation position, in which the interlock rests against the inner surface of the support strip and the second support surface of the hook strip.

7. A connection element as defined in claim 1, wherein the width (a) of the jaw and the minimum permissible distance (b) between an imaginary section line of the plane (E2), where the first support surface is located, and the plane (E3), where the second support surface is located, as well as the inner surface of the base strip that defines the lock chamber fulfill the following condition when viewed in a direction parallel to the plane (E2) of the first support surface:

$$b \leq \frac{a}{\tan\alpha}$$

where the angle $\alpha$ is the acute angle at which the first and the second support surfaces run slanted towards each other.

8. A connection element as defined in claim 1, wherein the inner surface of the base strip that defines the lock chamber extends in a planar fashion and wherein the inner surface of the base strip extends at a right angle in a cross-sectional view both towards the inner surface of the support strip as well as towards the inner surface of the transition section.

9. A connection element as defined in claim 1, wherein the interlock profile is designed in its dimensions for receiving an interlock of a LARSSEN sheet pile or of a HOESCH sheet pile to be connected.

10. A connection element as defined in claim 1, wherein a connection profile for connecting to the carrier element is provided at the side of the base strip that faces away from the interlock profile.

11. A connection element as defined in claim 1, wherein the attachment profile is defined by the base strip, a first straight jaw strip that protrudes at an angle of 90° from the side of the base strip that faces away from the interlock profile and a second jaw strip that protrudes from the base strip at a distance from the first jaw strip and is bent in the direction of the first jaw strip.

12. A connection element as defined in claim 11, wherein the bent second jaw strip of the attachment profile and the support strip of the interlock profile are designed at the base strip directly adjacent to each other and wherein their outer flat sides transition preferably flush into each other.

13. A connection element as defined in claim 11, wherein the bent second jaw strip of the attachment profile and the transition section of the hook strip are designed at the base strip directly adjacent to each other.

14. A connection element as defined in claim 10, wherein the attachment profile exhibits two jaw strips that protrude from the base strip and extend at least approximately parallel to each other, between which the carrier element is to be inserted with its fastening section for attachment.

15. A connection element as defined in claim 10, wherein the attachment profile, viewed in the cross-section of the connection element, is formed at the base strip offset with regard to the interlock profile in such a manner that one of the two jaw strips is set off towards the outside with regard to the transition section of the hook strip.

16. A connection element as defined in claim 1, wherein the connection element is designed as a weld-on element that can be connected to the carrier element by welding.

17. A connection element as defined in claim 16, wherein at the base strip that faces away from the interlock profile, a weld-on strip for welding to the carrier element protrudes in at least approximately rectangular fashion.

18. A connection element as defined in claim 16, wherein on the side of the base strip that faces away from the interlock profile, two weld-on elevations are provided that extend in the longitudinal direction of the connection element and extend parallel at a distance to each other preferably near the two face sides of the base strip.

19. A combination sheet pile wall that is formed of carrier elements, and at least one sheet pile that is arranged between two respective carrier elements, whereby a connection element is provided between the carrier elements and the sheet pile for the purpose of connecting them, where an interlock profile is formed at said connection element that engages with an interlock that is formed at the sheet pile and that is connected to the carrier element, the improvement wherein at least one of the connection elements is a connection element according to claim 1.

20. The sheet pile wall according to claim 19, wherein the carrier elements include at least one I beam and at least one sheet pile that is arranged between two respective carrier elements.

* * * * *